US007507097B2

(12) United States Patent
Stockel

(10) Patent No.: US 7,507,097 B2
(45) Date of Patent: Mar. 24, 2009

(54) DISTRIBUTION BOARD CONNECTION MODULE

(75) Inventor: Manfred Stockel, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 11/718,698

(22) PCT Filed: Oct. 31, 2005

(86) PCT No.: PCT/EP2005/011639

§ 371 (c)(1),
(2), (4) Date: May 4, 2007

(87) PCT Pub. No.: WO2006/048221

PCT Pub. Date: May 11, 2006

(65) Prior Publication Data

US 2008/0108236 A1 May 8, 2008

(30) Foreign Application Priority Data

Nov. 5, 2004 (DE) ..... 10 2004 054 534

(51) Int. Cl.
*H01R 13/62* (2006.01)

(52) U.S. Cl. ..... 439/159

(58) Field of Classification Search ..... 439/159, 439/65, 491, 152, 923, 142; 339/17
See application file for complete search history.

(56) References Cited

U.S. PATENT DOCUMENTS 2,976,510 A * 3/1961 Blain ..... 439/74
3,944,311 A * 3/1976 Sprenkle et al. ..... 439/157
3,957,334 A * 5/1976 Pass et al. ..... 439/634
4,072,379 A * 2/1978 Towne et al. ..... 439/65
4,975,805 A * 12/1990 Schmutzler ..... 361/754
5,328,288 A 7/1994 Masuda
5,492,481 A * 2/1996 Lewis ..... 439/159
5,613,874 A * 3/1997 Orlando et al. ..... 439/491
5,738,537 A * 4/1998 Setoguchi et al. ..... 439/159
6,302,699 B1 * 10/2001 Conorich et al. ..... 439/49
6,325,636 B1 * 12/2001 Hipp et al. ..... 439/61
6,350,133 B2 * 2/2002 Christensen et al. ..... 439/66
6,358,080 B1 * 3/2002 Conorich ..... 439/341
6,582,241 B1 * 6/2003 Lutz, Jr. ..... 439/157
6,729,902 B2 * 5/2004 Martich ..... 439/488
6,945,821 B2 9/2005 Stoner et al.
7,131,845 B2 * 11/2006 Mueller et al. ..... 439/49
7,267,550 B1 * 9/2007 Eckberg et al. ..... 439/65
2001/0016434 A1 * 8/2001 Christensen et al. ..... 439/66

(Continued)

FOREIGN PATENT DOCUMENTS

CH 554 130 1/1975

(Continued)

*Primary Examiner*—Hae Moon Hyeon
*Assistant Examiner*—Vladimir Imas
(74) *Attorney, Agent, or Firm*—Merchant & Gould P.C.

(57) ABSTRACT

A distribution connection module which is used in the telecommunication and data technology field includes a housing defining a cavity in which at least one conductor plate is arranged. The housing includes at least one opening in the front side thereof through which a connection module can be inserted. The connection module is connected to at least the conduction plate in the inserted state. At least one support for a lifting tool is arranged on the housing in a lateral manner in relation to the connection module.

10 Claims, 7 Drawing Sheets

U.S. PATENT DOCUMENTS

| | | | | |
|---|---|---|---|---|
| 2004/0219811 | A1 | 11/2004 | Centola et al. | |
| 2005/0186811 | A1* | 8/2005 | Lee et al. | 439/76.2 |
| 2006/0114660 | A1 | 6/2006 | Busse et al. | |

FOREIGN PATENT DOCUMENTS

| | | | |
|---|---|---|---|
| DE | 37 43 865 | A1 | 7/1989 |
| DE | 42 35 835 | A1 | 4/1993 |
| DE | 296 06 735 | U1 | 8/1996 |
| DE | 102 10 382 | C1 | 10/2003 |
| DE | 102 36 361 | A1 | 3/2004 |
| DE | 102 57 308 | B3 | 7/2004 |
| GB | 2 212 334 | A | 7/1989 |
| SE | CH 554 130 | | 1/1975 |

* cited by examiner

DISTRIBUTION BOARD CONNECTION MODULE

TECHNICAL FIELD

The invention relates to a distribution board connection module for telecommunications and data technology in accordance with the preamble of claim 1.

BACKGROUND

DE 102 36 361 A1 discloses a distribution board connection module for telecommunications and data technology, comprising a housing, in which input and output contacts are arranged such that they are accessible from the outside for the purpose of connecting lines and cables, the housing being formed with a cavity, in which at least one printed circuit board is arranged, the input and output contacts being arranged on the opposing end faces of the housing, the input contacts being associated with an input side, and the output contacts being associated with an output side, the input contacts being in the form of at least two opposing rows of contacts, and the output contacts being in the form of at least one plug-in connector. The input contacts are in this case in the form of connector modules, which have contact elements which each have an insulation-displacement contact and a fork contact, the latter being used to produce the electrical and mechanical contact with the printed circuit board. One possible design for the connector modules is described in DE 102 57 308 B3.

One disadvantage of the known distribution board connection module is the fact that the connector modules can only be isolated from the printed circuit board again with difficulty, which makes it more difficult, for example, to replace printed circuit boards.

SUMMARY

The invention is therefore based on the technical problem of providing a distribution board connection module, in which the connection between the connector module and the printed circuit board can be released more easily.

For this purpose, at least one support for a lever tool is arranged on the housing to the side of the connector module. This makes it possible to lever the connector module out from the printed circuit board with relatively little force, with the result that the connector module can be removed, and the printed circuit board is freely accessible.

In one preferred embodiment, a support is arranged on each of the two sides of the connector module. This provides, on the one hand, a higher degree of freedom during disassembly, since access may be gained using the lever tool in different ways; on the other hand, it is easier to remove the connector module if it is removed from both sides of the printed circuit board.

In a further, preferred embodiment, the support is in the form of a U-shaped elevation, comprising two limbs and a base part. In this case, the base acts as a bearing, and the limbs act as guides for the tool. It is further preferable in this case for the base to be slightly shorter or flatter than the limbs, so as to prevent lateral sliding-off.

In a further, preferred embodiment, the base of the elevation is beveled inwards, which further improves the guidance of the lever tool.

In a further, preferred embodiment, the connector module has at least one lateral opening, which protrudes from the end face of the distribution board connection module when it is inserted. It is then possible for the lever tool to be inserted in this opening. In place of the opening, projections are also conceivable, it being possible for the lever tool to be guided below said projections.

In a further, preferred embodiment, the housing is of at least two-part design, comprising a base part and a front part, the front part forming the end face bearing the connector modules. In this case, it is further preferable for the support to be arranged on the front part.

In a further, preferred embodiment, a display frame, which can be pivoted, is arranged on the housing, it being possible for the display frame, which can be pivoted, to assume at least two positions, the connector module(s) being freely accessible in a first pivoted-up position, and the display frame being arranged parallel to the end face in a second position. In this case, freely accessible means that the connector modules are connected and/or can be removed from the housing. However, this does not rule out the possibility of at least individual contacts or a connector module being accessible even in the position in which the display frame is parallel to the end face. The advantage of a display frame which can be pivoted compared to a plugged-on display frame is the fact that, whilst cables are connected or a connector module is removed, the display frame remains on the housing such that it cannot be lost.

BRIEF DESCRIPTION OF THE DRAWINGS

In a further, preferred embodiment, brackets are arranged laterally on the display frame, an attachment, which engages in each case in a pivoting bearing arranged on the housing, being arranged on the inside of each of said brackets, the attachment preferably being cylindrical.

In a further, preferred embodiment, the pivoting bearings are in the form of plates, which are perpendicular to the end face, having openings in which the attachments of the brackets can engage. In this case, the support for the lever tool is preferably higher than the pivoting bearings of the display frame, with the result that said pivoting bearings do not impede the levering-out.

The invention will be explained in more detail below with reference to a preferred exemplary embodiment. In the figures:

DETAILED DESCRIPTION

Figure 1:
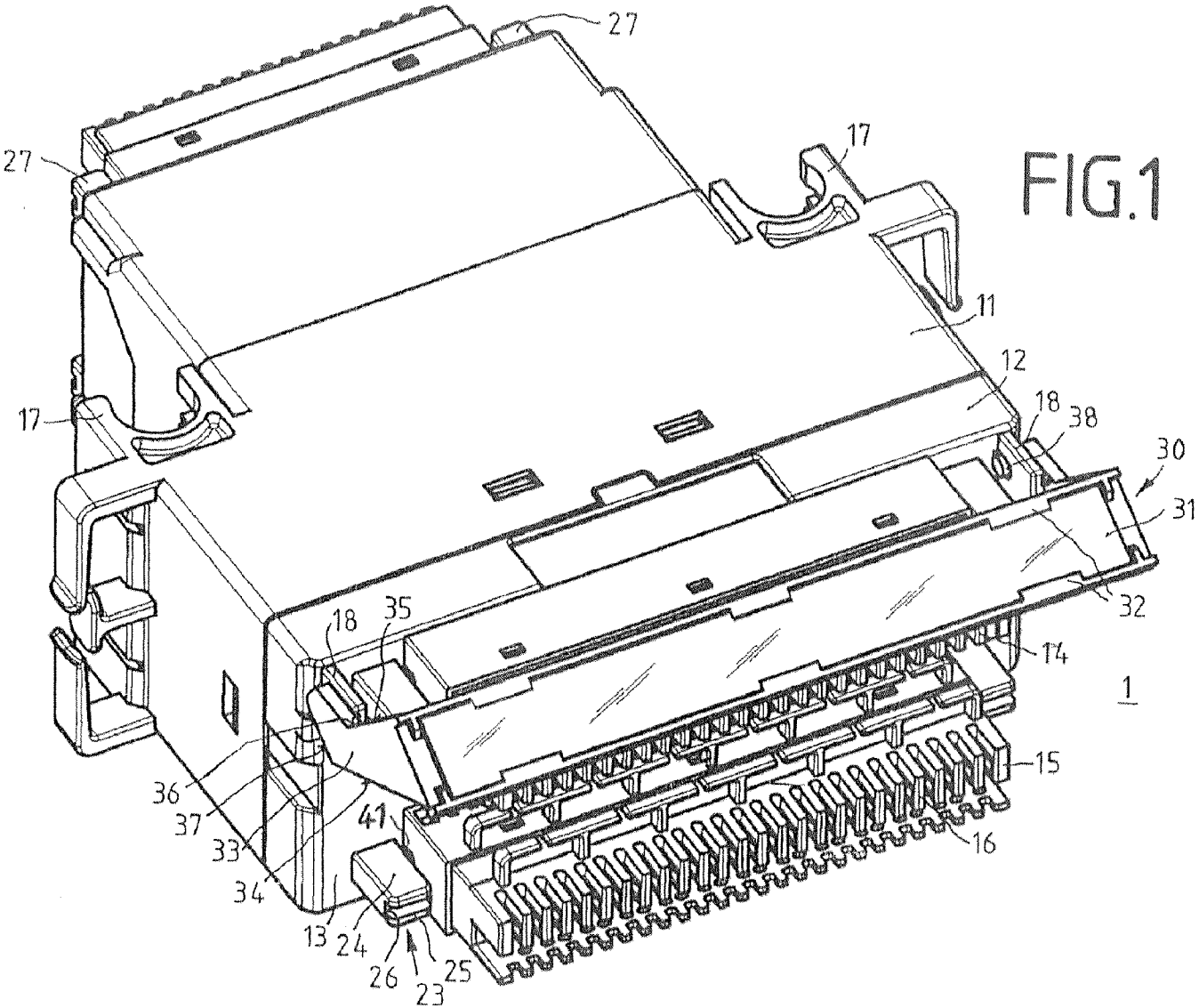
Figure 2:
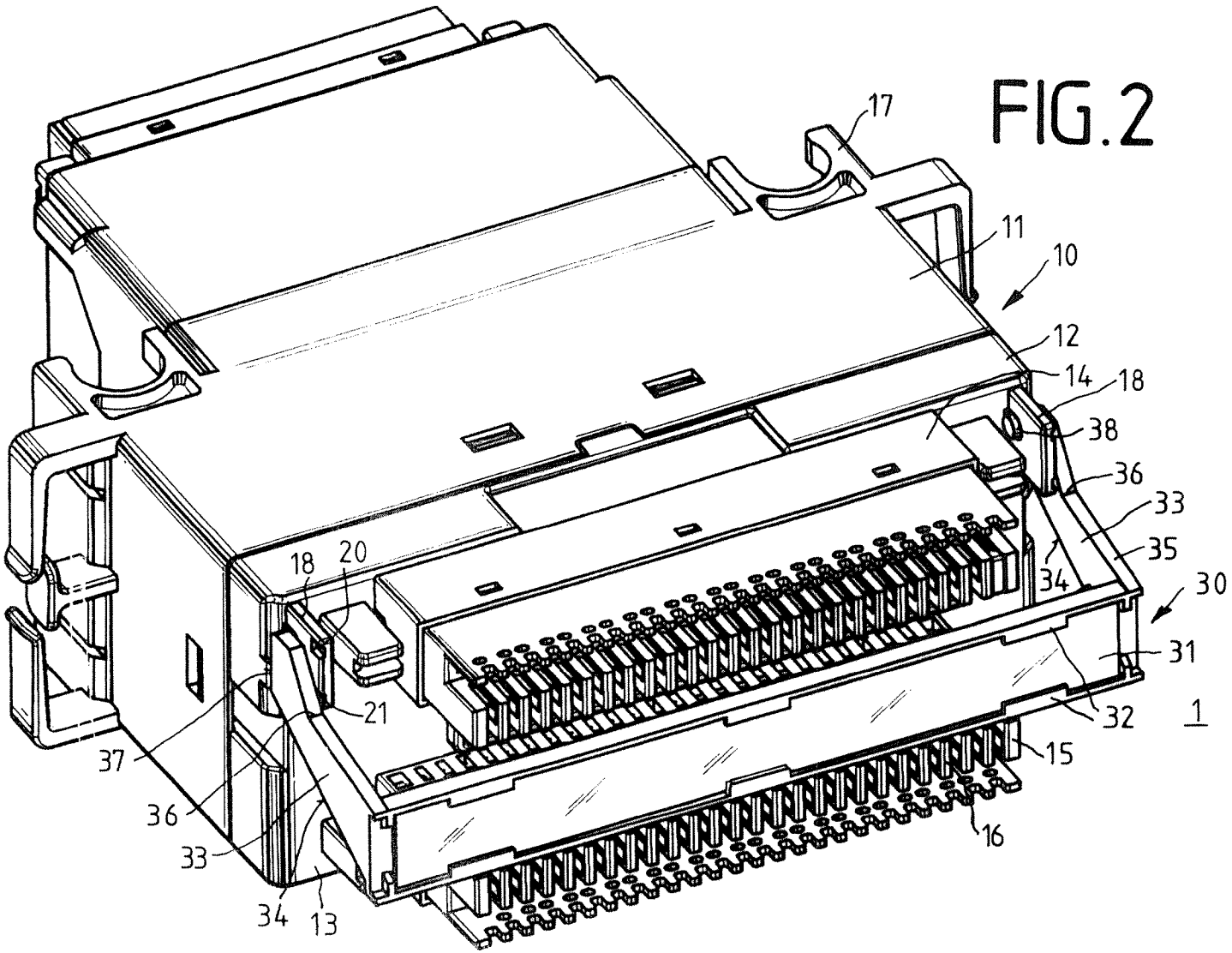
Figure 3:
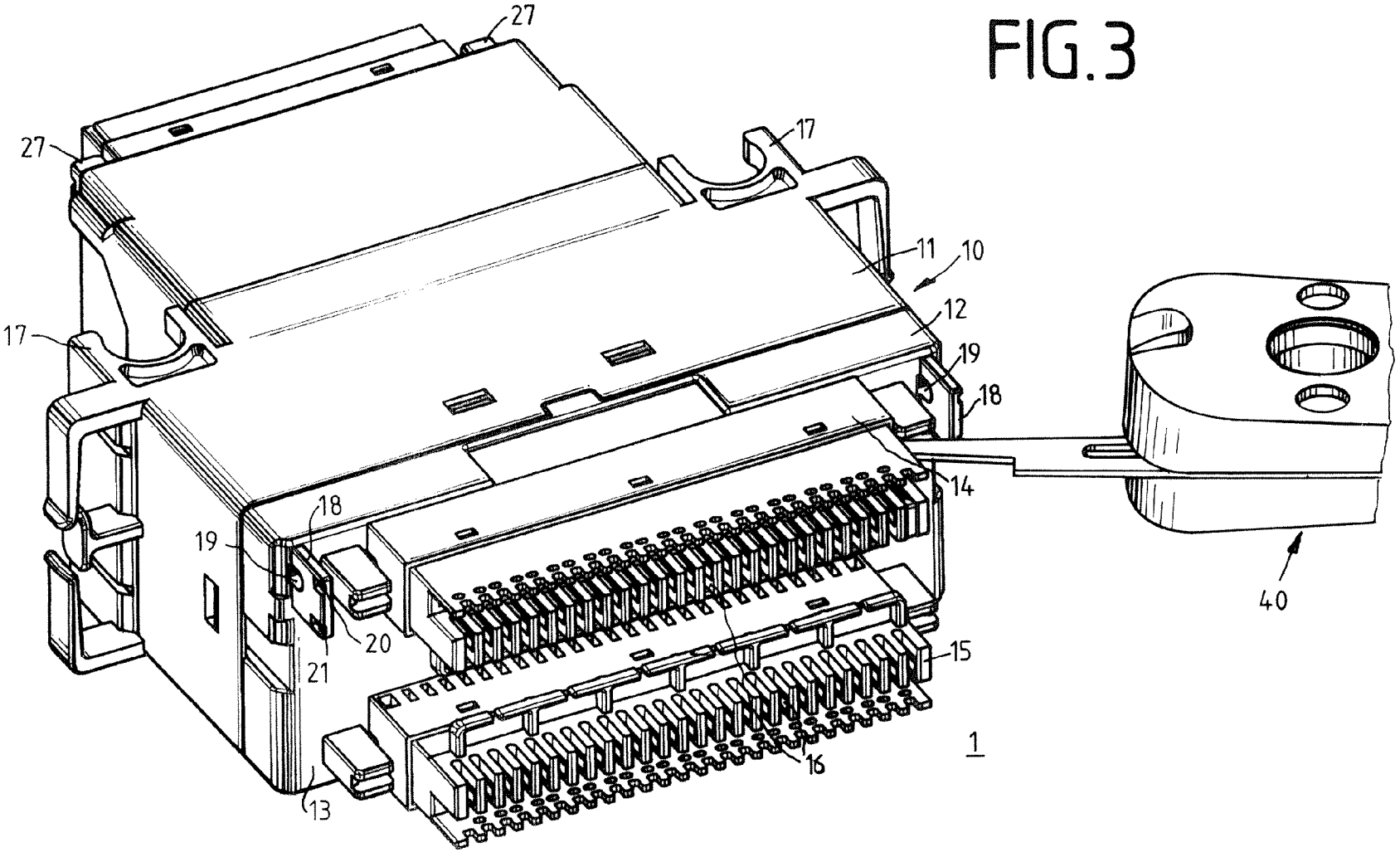
Figure 4:
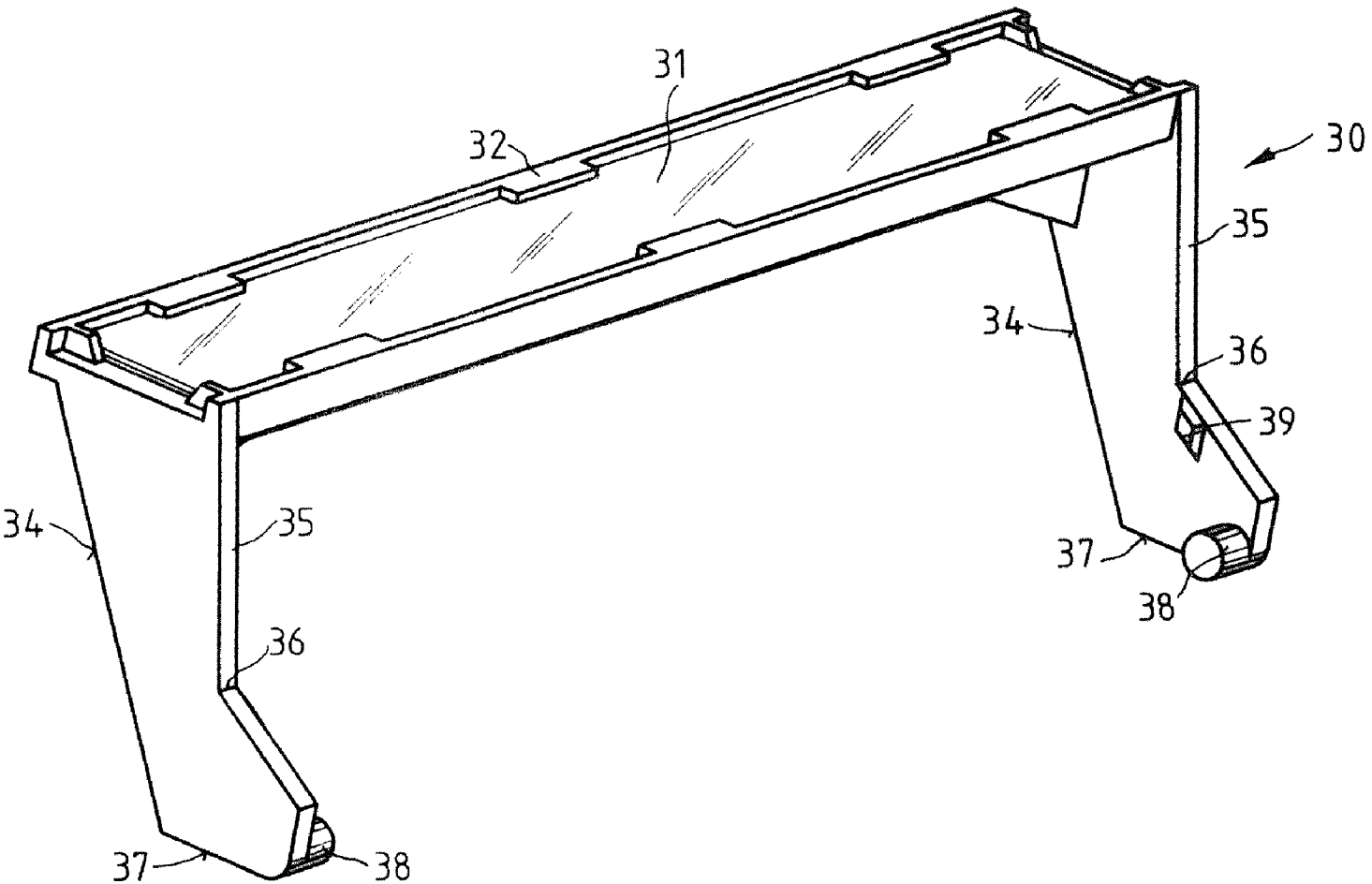
Figure 5:
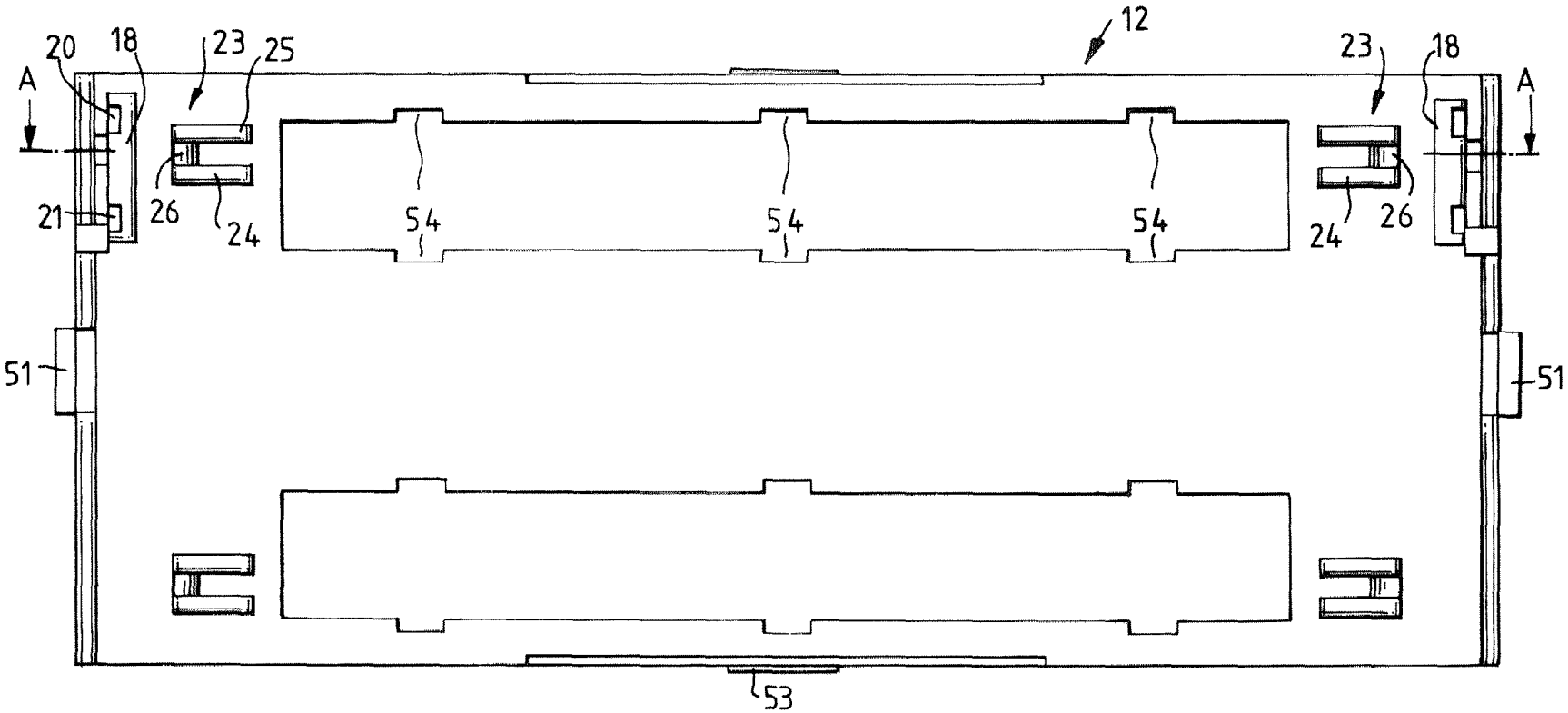
Figure 6:
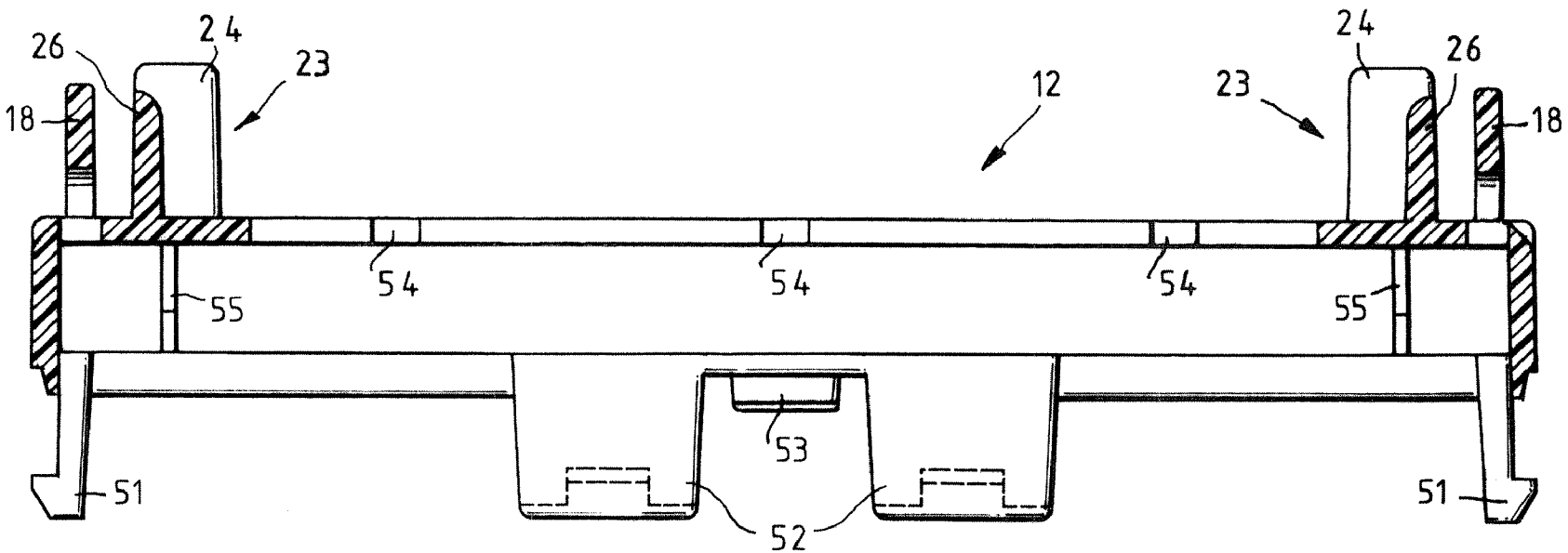

FIG. 1 shows a perspective front view of a distribution board connection module with a pivoted-up display frame, FIG. 2 shows a perspective front view with the display frame in a second position, FIG. 3 shows a perspective front view without the display frame but with a lever tool, FIG. 4 shows a perspective illustration of a display frame, FIG. 5 shows a front view of a distribution board connection module, and FIG. 6 shows a sectional illustration through the second housing part.

Figure 7:
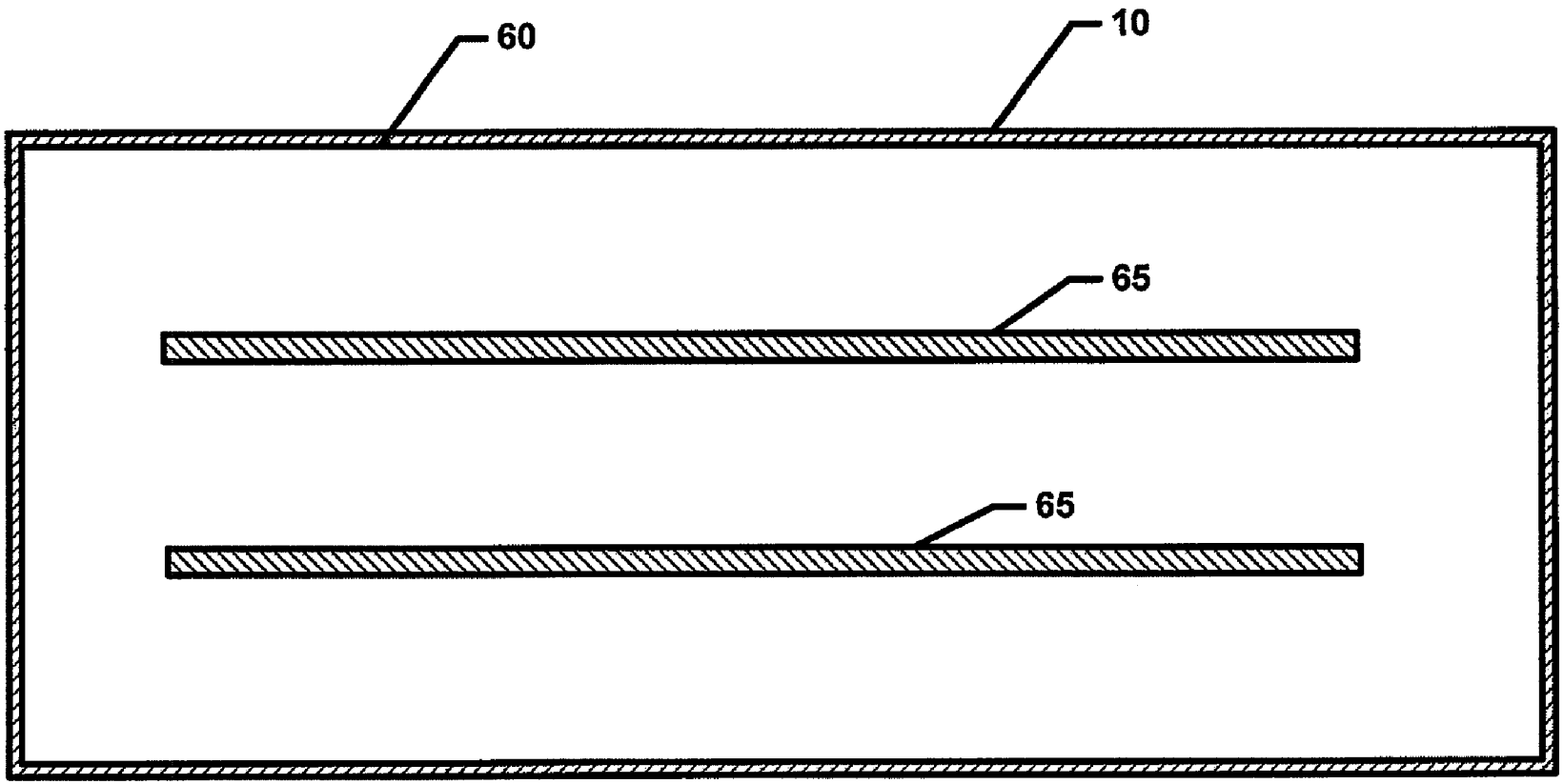

FIG. 7 is a schematic block diagram showing, in cross-section, a distribution board connection module including a housing defining an interior in which printed circuit boards are arranged.

The distribution board connection module 1 comprises a first housing part 11 (base part) and a second housing part 12 (front part), which are latched to one another and form a housing 10. The housing 10 has cavity 60, in which at least two printed circuit boards 65 are arranged. Furthermore, the second housing part 12, which defines the end face 13, has two openings in each of which a connector module 14, 15 is arranged. The connector modules 14, 15 themselves likewise have a two-part housing. The connector modules 14, 15 each have a row of contact elements which are formed with two contacts, an insulation-displacement contact 16 which is accessible from outside the housing 10 and an inwardly pointing fork contact, by means of which the contact element electrically and mechanically connects the printed circuit board. The contact elements are in this case supported in the housing of the connector module 14, 15 such that they can absorb the connection forces occurring when contact is made with the cables in the insulation-displacement contacts 16. Furthermore, the first housing part 11 has arched attachments 17, by means of which the distribution board connection module 1 can be latched onto round rods (not shown) of a mounting frame. The end face opposite the end face 13 preferably likewise has openings, through which further connector modules can be pushed. These connector modules may have the same design as the connector modules 14, 15 or may be in the form of multi-pin plug-in connectors. Two plates 18, which are perpendicular to the end face 13, are arranged in the upper region on the end face 13. The plates 18 each have a rounded-off opening 19 and two rectangular depressions 20, 21 (see FIG. 3). In this case, the depression 20 is slightly shorter than the depression 21, i.e. the depression 21 extends slightly more in the direction of the end face 13.

A display frame 30 comprises a label area, which is flat and is preferably covered by a transparent plastic strip 31, which can be pushed below webs 32. Two brackets 33 are arranged laterally on the label area. In this case, a lower edge 34 of the bracket 33 extends upwards uniformly at an angle, whereas an upper edge 35 initially has a slightly less steep incline, which initially results in a tapering of the bracket 33 (see FIG. 2). At a bend 36, the edge 35 then rises with more of an incline in order to then make the transition to a flat region. In the position shown in FIG. 2, in this case the rear edge 37 of the bracket is parallel to the end face 13 and is supported by a stop 22 of the housing part 12. In the region of the bend 36, a latching element 39 (see FIG. 4), which is preferably rhombic, is arranged on the inside of the bracket 33. In the region of the flat part of the edge 35, a cylindrical attachment 38 is arranged on the inside and engages in the opening 19 in the plate 18.

Furthermore, the second housing part 12 is formed with four U-shaped elevations 23. The U-shaped elevations 23 are each arranged laterally next to the openings for the connector modules 14, 15 and likewise stand perpendicularly on the end face 13. Each U-shaped elevation comprises two limbs 24, 25 and a base part 26, the base part 26 being shorter than the limbs 24, 25. Furthermore, the base part 26 is beveled inwards. This forms an inwardly inclined slot. In the line aligned with this beveled slot, the connector modules 14, 15 have an opening 41 (see FIG. 5), such that a lever tool 40 can be guided in the slot, the front part of the lever tool 40 passing into the opening 41 of the connector module 14, 15. In this case, the base part 26 forms a lever bearing, with the result that the latched-in connector module 14, 15 which has been pushed onto the printed circuit board can be levered out, as is illustrated in FIG. 3. As regards the precise design of the connector modules 14, 15, express reference is made to DE 102 57 308 B3, express reference hereby being made thereto.

FIG. 1 shows the display frame 30 in a first pivoted-up position. In this case, the latching elements of the brackets 33 are latched into the rectangular depression 20. In this position, the two connector modules 14, 15 can be connected or else levered out.

FIG. 2 shows the display frame 30 in a second, folded-down position, the display frame 30 being arranged centrally between the connector modules 14, 15. In this case, the latching elements of the brackets 33 are latched into the rectangular depressions 21, the label area being parallel to the end face 13. In this position, connection of cables or release is impeded by the display frame 30.

On the end face opposite the end face 13, it is possible to see elevations 27, which are likewise U-shaped and by means of which it is likewise possible for connector modules to be levered out. In this case, the U-shaped elevations 27 are slightly shorter than the U-shaped elevations 23. The U-shaped elevations 23 need to be slightly higher, since they need to be higher than the plates 18. In this case, however, it would be possible for the two U-shaped elevations 23 to be shorter where there are no plates 18 arranged, since this makes levering out easier.

FIG. 6 shows a sectional illustration through the second housing part 12 (front part), the section A-A (see FIG. 5) having been drawn through the two base parts of the U-shaped elevation 23. The housing part 12 has various latching hooks 51, 52 and 53, by means of which the housing part 12 can be latched to the first housing part 11. Furthermore, three recesses 54 and a part 55 of a supporting element for the printed circuit board (not shown) can be seen. The recesses are cutouts for latching lugs of the connector modules 14, 15, which prevent any latching-in.

LIST OF REFERENCE NUMERALS

1 Distribution board connection module
10 Housing
11 Housing part (base part)
12 Housing part (front part)
13 End face
14,15 Connector module
16 Insulation-displacement contact
17 Arched attachments
18 Plates
19 Opening
20,21 Rectangular depressions
23 U-shaped elevations
24,25 Limbs
26 Base part
27 U-shaped elevations
30 Display frame
31 Plastic strip
32 Webs
33 Brackets
34 Lower edge
35 Upper edge
36 Bend
37 Rear edge
38 Cylindrical attachment
39 Latching element
40 Lever tool
41 Opening
51,52,53 Latching hooks
54 Recesses
55 Part of a supporting element
60 Cavity
65 Printed circuit board

The invention claimed is:

1. A distribution board connection module for telecommunications and data technology, comprising:

a housing, the housing being formed with a cavity, in which at least one printed circuit board is arranged, the housing having at least one opening in an end face, in which a connector module can be inserted, the connector module being connected at least to the printed circuit board when inserted;

wherein at least one support for a lever tool is arranged on the housing to a side of the connector module;

wherein the support is in the form of a U-shaped elevation, comprising two limbs and a base part; and wherein the base part of the elevation is shorter than the limbs.

2. The distribution board connection module as claimed in claim 1, wherein at least two supports, which are each associated with one side of the connector module, are arranged on the housing.

3. The distribution board connection module as claimed in claim 1, wherein the base part is beveled inwards. Image Page 5

4. The distribution board connection module as claimed in claim 1, wherein the connector module is formed with at least one lateral opening.

5. The distribution board connection module as claimed in claim 1, wherein the housing is of at least two-part design, comprising a base part and a front part, the front part forming the end face which bears the connector modules.

6. The distribution board connection module as claimed in claim 5, wherein the support is arranged on the front part.

7. The distribution board connection module as claimed in claim 1, wherein a display frame, which can be pivoted, is arranged on the housing.

8. The distribution board connection module as claimed in claim 7, wherein brackets are arranged laterally on the display frame, an attachment, which engages in each case in a pivoting bearing arranged on the housing, being arranged on the inside of each of said brackets.

9. The distribution board connection module as claimed in claim 8, wherein the pivoting bearings are in the form of plates, which are perpendicular to the end face, having an opening.

10. The distribution board connection module as claimed in claim 8, wherein the support for the lever tool is higher than the pivoting bearings of the display frame.

* * * * *

UNITED STATES PATENT AND TRADEMARK OFFICE

CERTIFICATE OF CORRECTION

PATENT NO. : 7,507,097 B2
APPLICATION NO. : 11/718698
DATED : March 24, 2009
INVENTOR(S) : Stockel It is certified that error appears in the above-identified patent and that said Letters Patent is hereby corrected as shown below:

Col. 5, lines 16-17, claim 3: delete "Image Page 5"

Signed and Sealed this

First Day of December, 2009

David J. Kappos

David J. Kappos
*Director of the United States Patent and Trademark Office*